US010340610B2

(12) United States Patent
Hamada et al.

(10) Patent No.: US 10,340,610 B2
(45) Date of Patent: Jul. 2, 2019

(54) STRUCTURE FOR IMPROVING IMPACT STRENGTH OF A TERMINAL

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Hiroshi Hamada, Mie (JP); Takanobu Shimada, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 8 days.

(21) Appl. No.: 15/556,006

(22) PCT Filed: Feb. 18, 2016

(86) PCT No.: PCT/JP2016/054649
§ 371 (c)(1),
(2) Date: Sep. 6, 2017

(87) PCT Pub. No.: WO2016/143476
PCT Pub. Date: Sep. 15, 2016

(65) Prior Publication Data

US 2018/0062276 A1 Mar. 1, 2018

(30) Foreign Application Priority Data

Mar. 6, 2015 (JP) ..... 2015-044636

(51) Int. Cl.
*H01R 4/18* (2006.01)

(52) U.S. Cl.
CPC ..... *H01R 4/185* (2013.01)

(58) Field of Classification Search
CPC ..... H01R 4/185; H01R 4/4818
(Continued)

(56) References Cited

U.S. PATENT DOCUMENTS 3,609,642 A * 9/1971 Norden ..... H01R 4/4818 439/441
4,673,232 A * 6/1987 Kubota ..... H01R 4/4818 439/393

(Continued)

FOREIGN PATENT DOCUMENTS

JP 2001-319702 11/2001
JP 2004-303526 10/2004

(Continued)

OTHER PUBLICATIONS

Espacenet machine translation JP 2012-164523 (dated Aug. 2012).*
International Search Report of May 10, 2016.

*Primary Examiner* — Travis S Chambers
(74) *Attorney, Agent, or Firm* — Gerald E. Hespos; Michael J. Porco; Matthew T. Hespos

(57) ABSTRACT

A female terminal (30) to be connected to an end of a wire (20) in which a core (21) is covered with an insulation coating (22), and the wire (20) being pulled out rearward therefrom. The female terminal (30) includes two coating crimping pieces (39) extending in opposite lateral directions intersecting a pull-out direction of the wire (20) and to be crimped to an outer peripheral surface of the insulation coating (22). Compressing portions (41) are formed on the surface of each coating crimping piece (39) that faces the insulation coating (22) and are disposed adjacent a front edge of each coating crimping piece (39). Each compressing portion has an internal space narrowed toward a rear end from the front edge of the coating crimping piece (39).

12 Claims, 5 Drawing Sheets

(58) Field of Classification Search
USPC ..... 439/865, 441, 873, 877, 878, 882
See application file for complete search history.

(56) References Cited

U.S. PATENT DOCUMENTS 5,281,760 A * 1/1994 Kikuchi ..... H01R 11/28 174/74 R
5,396,033 A * 3/1995 Piriz ..... H01R 4/186 174/71 R
6,132,239 A * 10/2000 Nærland ..... H01R 4/26 439/439
6,206,727 B1 * 3/2001 Aoyama ..... H01R 9/0518 439/424
6,554,644 B2 * 4/2003 Koide ..... H01R 9/0518 439/108
7,497,730 B2 * 3/2009 Kobayashi ..... H01R 4/185 439/585
8,333,624 B2 * 12/2012 Kakuta ..... H01R 4/62 439/877
8,616,928 B2 * 12/2013 Uchiyama ..... H01R 4/184 439/877
2001/0016460 A1 * 8/2001 Koide ..... H01R 4/184 439/877
2010/0105257 A1 * 4/2010 Kumakura ..... H01R 4/185 439/877
2013/0273787 A1 * 10/2013 Mitose ..... H01R 4/185 439/878
2013/0344738 A1 * 12/2013 Kanda ..... H01R 13/6592 439/607.5
2015/0079857 A1 * 3/2015 Kawamura ..... H01R 43/0482 439/877

FOREIGN PATENT DOCUMENTS

JP 2010-040456 2/2010
JP 2012-119216 6/2012
JP 2012164523 A * 8/2012 ..... H01R 4/184

* cited by examiner

FIG. 4
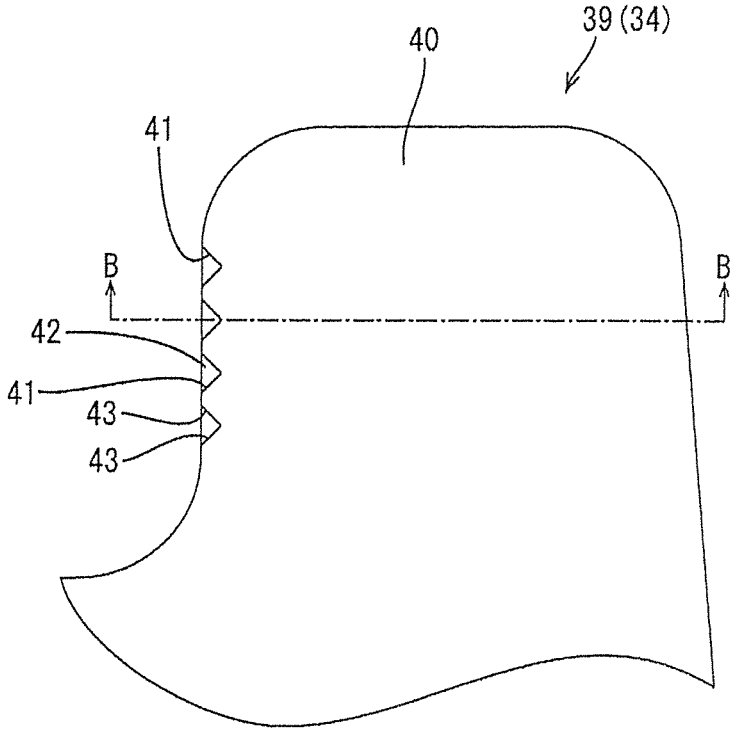
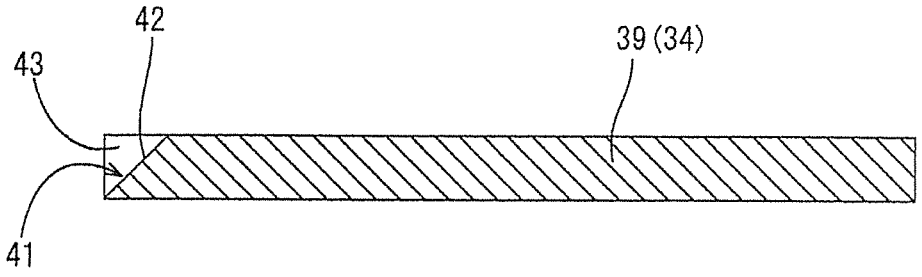
FIG. 5

STRUCTURE FOR IMPROVING IMPACT STRENGTH OF A TERMINAL

BACKGROUND

Field of the Invention

This specification relates to a terminal and a wire with terminal.

Description of the Related Art

Japanese Unexamined Patent Publication No. 2012-119216 discloses a wire with terminal in which a terminal is connected to an end of a wire. This wire with terminal includes a coating crimping portion to be crimped to an insulation coating of the wire. Claws are provided on side edges of both front and rear sides of the coating crimping portion and are configured to bite into the insulation coating by projecting in toward the insulation coating.

The claws of the terminal of the above wire with terminal project in toward the insulation coating and bite into the insulation coating when the wire is pulled rearwardly so that the wire will not detach from the terminal. However, the claws may tear the insulation coating if the wire is pulled by a strong impact applied thereto. In such a case, impact strength of the terminal against the wire is reduced.

A structure for improving impact strength of a terminal against a wire is disclosed in this specification.

SUMMARY

This specification is directed to a terminal to be connected to an end of a wire in which a core is covered with an insulation coating, and with the wire being pulled out rearwardly. The terminal includes a coating crimping portion formed to extend in a direction intersecting with a pull-out direction of the wire and configured to be crimped to an outer peripheral surface of the insulation coating. A compressing portion is open forward, and is provided by recessing the coating crimping portion. An internal space is formed at a position of a front end edge part of the coating crimping portion on the side of the insulation coating and is narrowed toward a rear side from a front end edge of the coating crimping portion.

This specification also is directed to a wire with terminal including a wire having a core covered with an insulation coating, and the above terminal to be connected to the wire.

According to the terminal thus configured, the coating crimping portion is crimped to the outer peripheral surface of the insulation coating and the compressing portion is pressed against the insulation coating. Thus, if a strong impact is applied to the wire and the wire suddenly is pulled rearward, the insulation coating compressed at the compressing portion is displaced rearwardly and the insulation coating is compressed further by the compressing portion. A part of the insulation coating not compressed before the coating crimping portion slips into the internal space of the compressing portion through a front end opening of the compressing portion and is pressed and compressed by the compressing portion.

That is, not only a part of the insulation coating already compressed, but also the part of the insulation coating not compressed before the coating crimping portion are moderately compressed at the compressing portion and hardened. This causes the compressed and hardened insulation coating to hold on. Thus, the coating crimping portion is less likely to detach from the insulation coating and impact strength of the terminal against the wire can be improved.

The compressing portion may have a smaller depth in a plate thickness direction toward the rear from the front end edge of the coating crimping portion on an inner side of the coating crimping portion on the side of the insulation coating.

A part of the compressing portion to be brought into contact with the insulation coating in the plate thickness direction may be a flat compressing surface inclined toward the rear side from the front end edge.

The compressing portion may be provided over an entire width in an extending direction of the coating crimping portion.

The compressing portion may be narrowed in the extending direction of the coating crimping portion toward the rear side.

The compressing portion may be formed into a triangular shape having a vertex on a rear end on an inner surface of the coating crimping portion on the side of the insulation coating, and the triangular compressing portion may be formed symmetrically in the extending direction of the coating crimping portion.

A plurality of the compressing portions may be provided side by side in the extending direction of the coating crimping portion.

According to this specification, it is possible to improve impact strength of a terminal against a wire.

BRIEF DESCRIPTION OF DRAWINGS

FIG. 4 is an enlarged plan view of an essential part of FIG. 3.

FIG. 5 is a section along B-B of FIG. 4.

DETAILED DESCRIPTION

An embodiment is described with reference to FIGS. 1 to 5.

Figure 2:
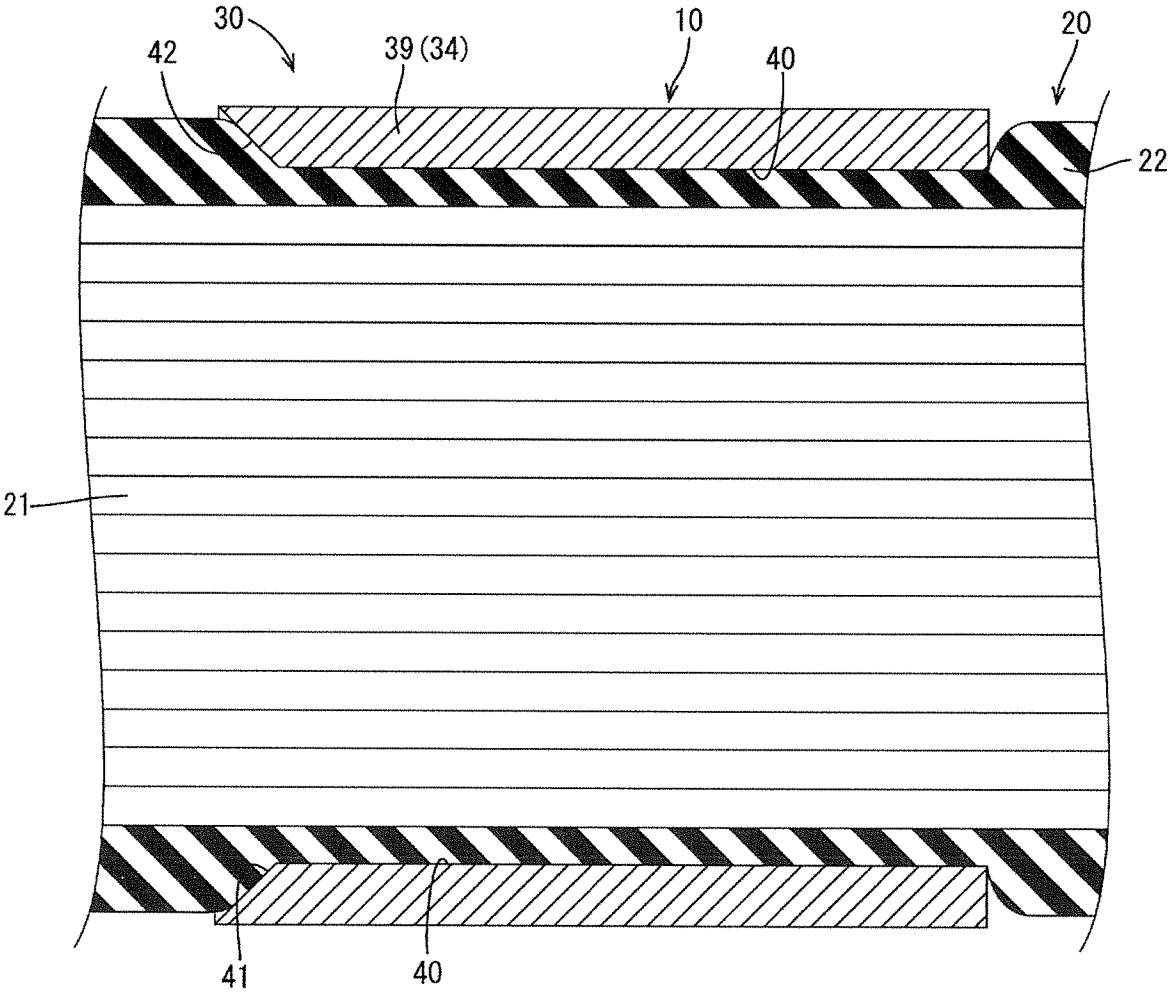
FIG. 2 is a section along A-A of FIG. 1.
Figure 3:
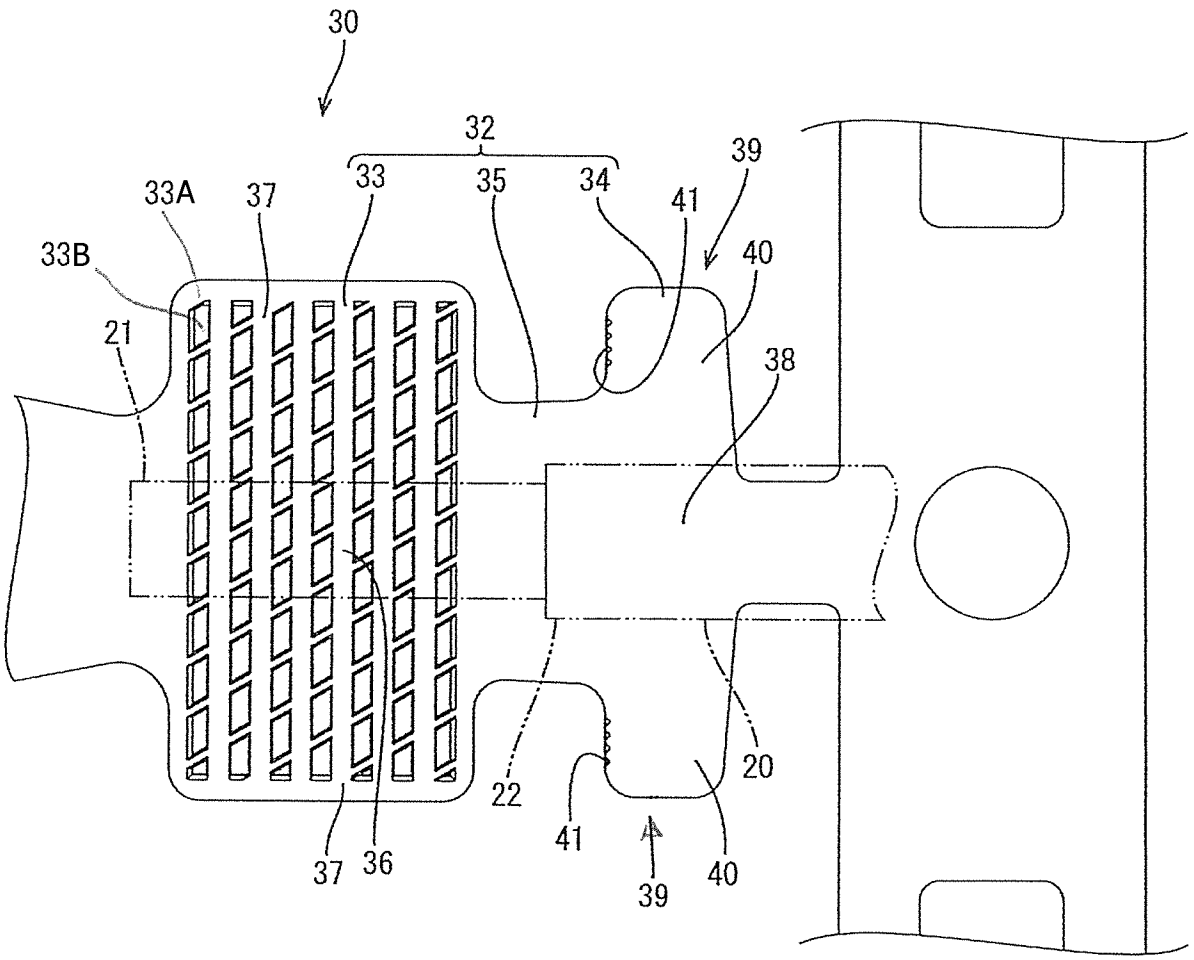
FIG. 3 is a plan view partly in section of a terminal in a developed state.

A wire with terminal 10 to be routed in a vehicle is illustrated in this embodiment and includes a female terminal 30 and a wire 20 connected to the female terminal 30 and pulled out rearwardly from the female terminal 30. Note that, in the following description, a vertical direction is based on a vertical direction of FIG. 1, and a lateral direction is based on a vertical direction of FIGS. 2 and 3. Further, a front-rear direction is based on a lateral direction in FIGS. 1, 2 and 3 and a left side and a right side in FIGS. 1, 2 and 3 are respectively referred to as a front side and a rear side.

Figure 1:
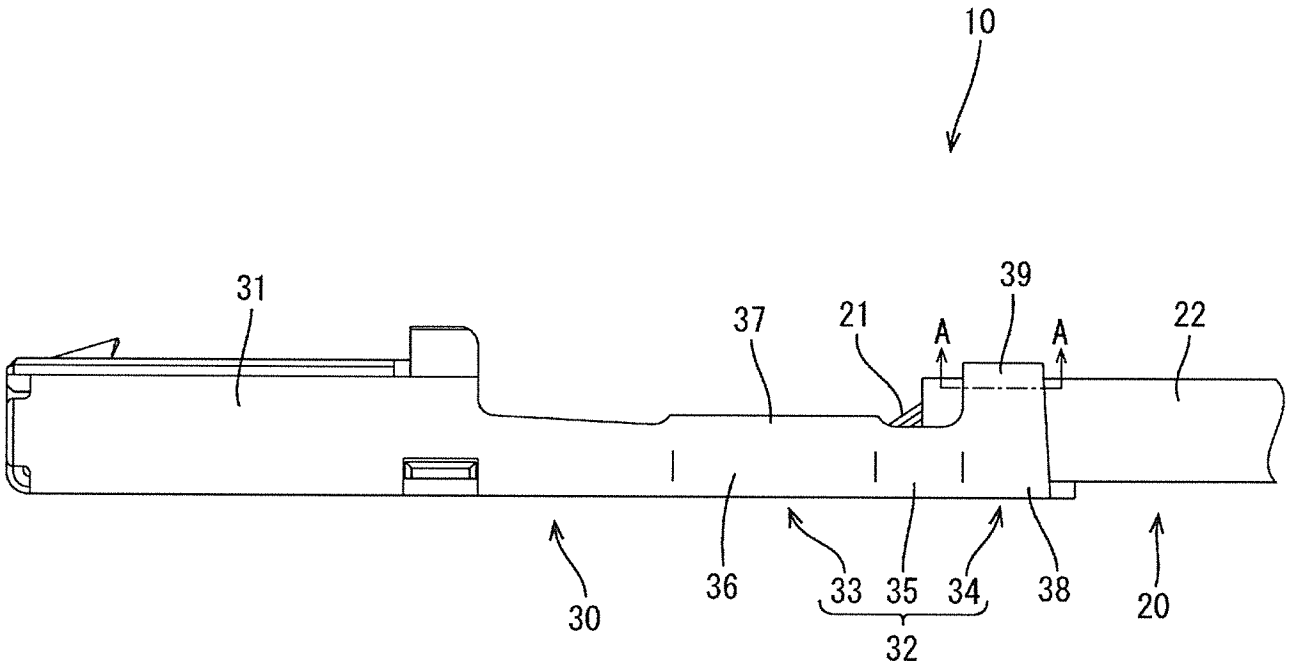
FIG. 1 is a side view of a wire with terminal according to a first embodiment.

As shown in FIG. 1, the wire 20 is composed of a core 21 formed of a plurality of metal thin wires and an insulation coating 22 made of insulating synthetic resin and covering the outer periphery of the core 21. The metal thin wires can be made of aluminum, aluminum alloy, copper, copper alloy or the like. In this embodiment, aluminum alloy is used.

As shown in FIG. 1, the wire 20 has the insulation coating 22 stripped at an end, whereby the core 21 is exposed forwardly from the insulation coating 22, and the female terminal 30 is connected to this end.

The female terminal 30 is formed by working a metal plate material excellent in conductivity by a press or the like.

As shown in FIG. 1, the female terminal 30 includes a connecting tube 31 to be connected to an unillustrated male terminal and a crimping portion 32 connected behind the connecting tube 31.

The connecting tube 31 is in the form of a rectangular tube into which a tab-like male-side connecting portion of a male terminal is insertable, and the female terminal 30 and the male terminal are connected electrically by inserting the male-side connecting portion into the connecting tube 31.

The crimping portion 32 includes a core crimping portion 33 to be crimped to the core 21 of the wire 20, a coating crimping portion 34 to be crimped to the insulation coating 22 of the wire 20 and a linking portion 35 linking the core crimping portion 33 and the coating crimping portion 34 one after the other, and the coating crimping portion 34 is formed behind the core crimping portion 33 via the linking portion 35.

The core crimping portion 33 has a substantially rectangular shape long in the lateral direction in a developed state as shown in FIG. 3 and is formed such that a core crimping piece 37 is provided on each lateral side of a core placing portion 36 on which the core 21 of the wire 20 is to be placed.

As shown in FIG. 3, the core 21 exposed from the insulation coating 22 of the wire 20 is placed on the core placing portion 36 while extending in the front-rear direction, and the wire 20 placed on the core placing portion 36 is pulled out rearward from the core placing portion 36. Note that a boundary part between the core 21 and the insulation coating 22 of the wire 20 pulled out rearward from the core placing portion 36 is located on the linking portion 35 and a part of the wire 20 including the insulation coating 22 without being stripped is pulled out behind the linking portion 35 as shown in FIGS. 1 and 3.

The core crimping pieces 37 extend away from each other from both lateral sides of the core placing portion 36, and have a substantially rectangular shape long in the front-rear direction, which is an extending direction of the wire 20. The core crimping pieces 37 are crimped to the core 21 so that base end parts on the side of the core placing portion 36 extend along the outer periphery of the core 21 placed on the core placing portion 36 and tip parts are wound inwardly with respect to the core 21.

Further, as shown in FIG. 3, serrations 33A are provided from the core placing portion 36 to the core crimping pieces 37 on a surface of the core crimping portion 33 on the side of the core 21 and are to be brought into contact with the core 21.

The serrations 33A are composed of recesses 33B with edges having a parallelogram shape. When the core crimping portion 33 is crimped to the core 21, the hole edges of the recesses 33B bite into the core 21. Thus, an oxide film formed on the core 21 is destroyed and the core crimping piece 33 is firmly crimped and fixed to the core 21.

The coating crimping portion 34 has a substantially rectangular shape long in the lateral direction in a developed state, and a length of the coating crimping portion 43 in the front-rear direction is shorter than a length of the core crimping portion 33 in the front-rear direction (about half that of the coating crimping portion 34). Further, the coating crimping portion 34 is formed such that a coating crimping piece 39 is provided on both lateral sides of a coating placing portion 38 on which the insulation coating 22 of the wire 20 is to be placed.

A part of the wire 20 including the insulation coating 22 without being stripped is placed on the coating placing portion 38 to extend in the front-rear direction, and the wire 20 placed on the coating placing portion 38 is pulled out farther rearward from the coating placing portion 38.

The coating crimping pieces 39 extend away from each other along the lateral direction from the both lateral sides of the coating placing portion 38. In other words, the coating crimping pieces 39 extend in the lateral direction intersecting with a pull-out direction of the wire 20, and both front and rear side edges of each coating crimping piece 39 extend straight in the lateral direction.

Further, the coating crimping pieces 39 are crimped radially to the outer peripheral surface of the insulation coating 22 to be wound around the outer periphery of the insulation coating 22 of the wire 20 placed on the coating placing portion 38.

Inner parts of the coating crimping pieces 39 on the side of the insulation coating 22 serve as high compressing portions 40 extending in the front-rear direction along the wire 20 as shown in FIG. 2. When the coating crimping pieces 39 are crimped to the insulation coating 22, the high compressing portions 40 press the insulation coating 22 radially inward and bite into the insulation coating 22, so that the coating crimping pieces 39 are crimped and fixed firmly to the insulation coating 22. Further, the high compressing portions 40 press the insulation coating 22 radially inward so that a part of the insulation coating 22 pressed by the high compressing portions 40 is in a highly compressed state by being more radially compressed than in parts of the insulation coating 22 in a non-compressed state arranged adjacent to the coating crimping portions 39 in the front-rear direction.

Plural compressing portions 41 are provided successively in the lateral direction (extending direction of the coating crimping pieces 39) along the front end edges of the coating crimping pieces 39 on front end parts of the high compressing portions 40 of the coating crimping pieces 39.

All of the respective compressing portions 41 are formed to have the same size as shown in FIGS. 3 and 4, and each compressing portion 41 is configured by three surfaces, i.e. a flat compressing surface 42 tapered in the lateral direction and inclined to have a smaller depth in a plate thickness direction toward a rear side from the front end edge of the coating crimping piece 39, and two flat compressing side surfaces 43 approaching each other in the lateral direction and facing each other in the lateral direction toward the rear side so as to extend along the compressing surface 42 from the front end edge of the coating crimping piece 39, as shown in FIGS. 3 to 5.

Accordingly, each compressing portion 41 is formed to have a triangular opening in a plan view with one side serving as the front end edge of the coating crimping piece 39 in the high compressing portion 40, and a substantially rectangular opening open forward within the plate thickness of the coating crimping piece 39. An internal space of the compressing portion 41 enclosed by the three surfaces, i.e. the compressing surface 42 and the two compressing side surfaces 43 is formed by recessing the high compressing portion 40 to become narrower toward the rear side from the front end edge of the coating crimping piece 39.

Further, the triangular opening of the compressing portion 41 in the high compressing portion 40 has an isosceles triangular shape symmetrical in the lateral direction and narrower in the lateral direction toward the rear side by setting lengths in the front-rear direction and depths of the compressing side surfaces 43 to be substantially equal.

Further, when the coating crimping pieces 39 are crimped to the insulation coating 22, the compressing surfaces 42 of the respective compressing portions 41 press the insulation coating 22 radially inward, as shown in FIG. 2. Thus, the insulation coating 22 is compressed gradually in a radial direction (plate thickness direction) toward the rear side from the front end edges of the coating crimping pieces 39. That is, the insulation coating 22 is compressed gradually toward the rear by being pressed by the compressing surfaces 42 of the compressing portions 41 from a non-compressed state before the coating crimping pieces 39, and is in a highly compressed state by being pressed by the high compressing portions 40 to be most compressed behind the compressing portions 41.

The wire with terminal 10 of this embodiment is configured as described above. Next, how to assemble the wire with terminal 10 is briefly described and functions and effects of the wire with terminal 10 are described.

In assembling the wire with terminal 10, the wire 20 having the insulation coating 22 stripped at the end to expose the core 21 is placed on the core placing portion 36 of the core crimping portion 33 and the coating placing portion 38 of the coating crimping portion 34 of the compressing portion 32. The wire 20 is placed so that the boundary part between the core 21 and the insulation coating 22 is disposed on the linking portion 35 of the crimping portion 32, thereby determining the position of the wire 20 with respect to the female terminal 30 in the front-rear direction.

Subsequently, the core crimping pieces 37 in the core crimping portion 33 are crimped to the core 21 of the wire 20 by being wound inwardly, and the coating crimping pieces 39 in the coating crimping portion 34 are crimped by being wound on the insulation coating 22 of the wire 20.

In this crimping process, when the core crimping portion 33 is crimped to the core 21, the hole edges of the recesses 33B of the serrations 33A bite into the core 21 so that the oxide film formed on the core 21 is destroyed and the core crimping portion 33 is crimped and fixed fixed to the core 21.

Further, when the coating crimping portion 34 is crimped to the insulation coating 22, the high compressing portions 40 of the coating crimping pieces 39 bite into the insulation coating 22 while pressing the insulation coating 22 radially inward. Thus, the coating crimping pieces 39 are crimped and fixed firmly to the insulation coating 22.

The compressing surfaces 42 of the compressing portions 41 press the insulation coating 22 radially inward at the front end parts of the respective coating crimping pieces 39 so that the insulation coating 22 is compressed gradually toward the rear. Thus, the insulation coating 22 near a part where the compressing portions 41 are disposed is compressed gradually toward the rear from the non-compressed state before the coating crimping pieces 39 by being pressed by the compressing portions 41, as shown in FIG. 2, and the insulation coating 22 is highly compressed by the high compressing portions 40 behind the compressing portions 41.

When the core crimping portion 33 is crimped and fixed to the core 21 and the coating crimping portion 34 is crimped and fixed to the insulation coating 22 as described above, the wire with terminal 10 is completed.

Generally, in a wire with terminal, a core holding force of a core crimping portion to hold a core is reduced if the core of a wire is thinned. Thus, if the core is thinned, for example, due to a higher strength of the core, a holding force of a female terminal cannot be ensured only by a core crimping portion and highly compressing portions of a coating crimping portion and impact strength may be reduced when a strong impact is applied to the wire and the wire is suddenly pulled rearwardly.

However, according to this embodiment, the compressing portions 41 are provided side by side in the lateral direction along the front end edges of the respective coating crimping pieces 39 on the front end parts of the high compressing portions 40 of the coating crimping pieces 39, and the three surfaces, i.e. the compressing surface 42 and the two compressing side surfaces 43 of each compressing portion 41 are narrowed gradually toward the rear. Thus, when the wire 20 is pulled rearward, the insulation coating 22 gradually compressed by the compressing portions 41 is displaced rearward and further compressed by the compressing surfaces 42 and the compressing side surfaces 43. Further, the insulation coating 22 in the non-compressed state before the respective coating crimping pieces 39 is displaced rearwardly, slips into the compressing portions 41 through the front end openings of the compressing portions 41 and is compressed moderately from behind by being pressed by the compressing surfaces 42 and the compressing side surfaces 43 of the compressing portions 41.

That is, not only a part of the insulation coating 22 already compressed by the compressing portions 41, but also a part of the insulation coating 22 not compressed before the coating crimping pieces 39 are compressed moderately at the compressing portions 41 so that the insulation coating 22 is hardened. Specifically, the compressed and hardened insulation coating 22 holds on at a plurality of positions on the outer peripheral surface thereof. Thus, a holding force of the coating crimping portion 34 to hold the wire 20 is improved and impact strength of the female terminal 30 against the wire 20 can be improved. Accordingly, the detachment of the female terminal 30 from the wire 20 can be prevented.

According to this embodiment, the compressing portions 41 are formed along the front end edges of the coating crimping pieces 39, thereby distributing a load acting on the insulation coating 22 in a circumferential direction. Thus, the breakage of the insulation coating 22 can be suppressed and impact strength of the female terminal 30 against the wire 20 can be improved.

The compressing surfaces 42 and the compressing side surfaces 43 of the respective compressing portions 41 are flat. Thus, even if the wire 20 is pulled suddenly rearward, the insulation coating 22 is compressed smoothly and moderately at a uniform rate. That is, as compared, for example, to the case where a part to be held in contact with the insulation coating is formed into an arch shape, there is no part where the compression of the insulation coating 22 suddenly changes and the damage of the insulation coating 22 resulting from a sudden change of the compression can be suppressed.

Figure 6:
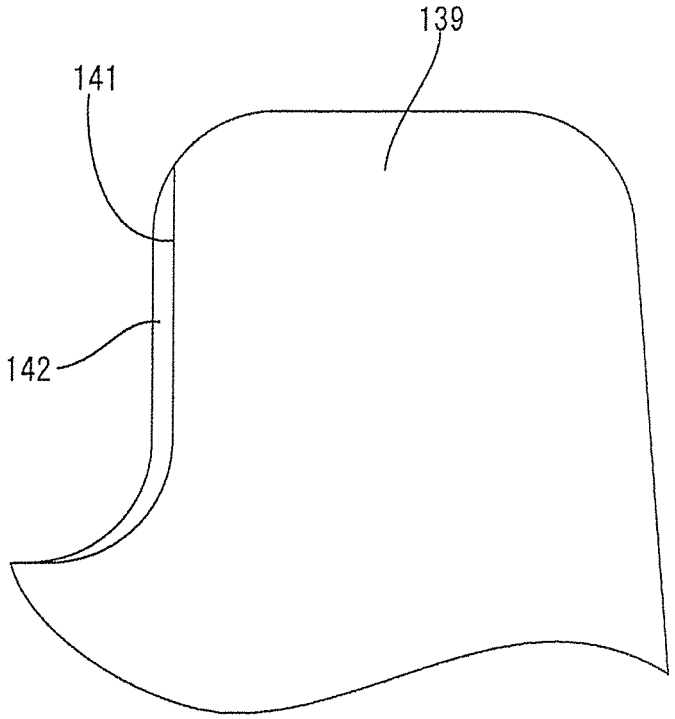
FIG. 6 is an enlarged plan view of an essential part of FIG. 4 according to a second embodiment.

Furthermore, according to this embodiment, the compressing side surfaces 43 in the compressing portion 41 are symmetrical in the lateral direction by setting the lengths thereof in the front-rear direction substantially equal to the depths thereof. Thus, the insulation coating 22 can be compressed equally in the lateral direction. That is, since the insulation coating 22 can be compressed uniformly in the circumferential direction, impact strength of the female terminal 30 against the wire 20 can be improved as compared, for example, to the case where an insulation coating is compressed non-uniformly in the circumferential direction. Next, a second embodiment is described with reference to FIG. 6.

A coating crimping piece 139 of the second embodiment is different from the coating crimping piece 39 of the first embodiment in the shape of the compressing portions, and components, functions and effects common to the first embodiment are the same and, hence, not described. Further, the same components as in the first embodiment are denoted by the same reference signs.

Each coating crimping piece 139 of the second embodiment is formed with one compressing portion 141 extending over the entire coating crimping piece 139 in the lateral direction along the front end edge of the coating crimping piece 139. That is, a compressing surface 142 of the compressing portion 141 is a wide inclined surface formed over the entire width of the coating crimping piece 139.

Accordingly, when the coating crimping pieces 139 are crimped to an insulation coating 22, the compressing surfaces 142 press the insulation coating 22 radially inwardly on the entire periphery of a coating crimping portion 34 excluding a coating placing portion 38, and a part of the insulation coating 22 pressed by the compressing surfaces 142 is compressed gradually in a radial direction (plate thickness direction) toward a rear side.

Accordingly, if a strong impact is applied to the wire and the wire is pulled suddenly rearward, the insulation coating 22 is compressed moderately to enhance strength on the entire periphery of the coating crimping portion 34 excluding the coating placing portion 38, and a holding force of the entire female terminal 30 to hold the wire 20 is improved. Thus, impact strength of the female terminal 30 against the wire 20 can be improved further.

Further, according to this embodiment, when the respective coating crimping pieces 139 are crimped to the insulation coating 22, the compressing surfaces 142 come into surface contact with all parts of the insulation coating 22 on a front end edge part where the coating crimping pieces 139 are crimped, and pointed edges or the like do not come into contact. Thus, the insulation coating 22 is not damaged and fractured when the wire suddenly is pulled rearward. Specifically, it is possible to prevent a reduction of the holding force of the female terminal 30 to hold the wire 20 due to the fracture of the insulation coating 22 by edges or the like.

This specification is not limited to the above described and illustrated embodiments. For example, the following various modes are also included.

In the first embodiment, the compressing portion 41 is configured into an isosceles triangular shape in a plan view which is narrowed in the lateral direction toward the rear side in the developed state. However, without limitation to this, in the developed state, the compressing portion may be configured into a right triangular shape in a plan view, one of left and right sides of which extends straight in the front-rear direction, an equilateral triangular shape in a plan view or a semicircular shape in a plan view which is narrowed toward the rear side. Further, the compressing portion may be configured into a rectangular shape in a plan view which is not narrowed in the lateral direction.

In the first embodiment, the compressing portion 41 is confirmed to have a substantially rectangular opening open forward. However, without limitation to this, the compressing portion may be configured to have a triangular or semicircular opening open forward.

In the first embodiment, compressing portions 41 are provided successively side by side in the lateral direction on the front end part of the coating crimping piece 39. However, without limitation to this, compressing portions may be provided at intervals on the front end edge part of the coating crimping piece.

In the above embodiments, the compressing surface 42 and the compressing side surfaces 43 of the compressing portion 41 and the compressing surface 142 of the compressing portion 141 are flat. However, without limitation to this, the compressing surfaces and the compressing side surfaces may be curved surfaces.

In the above embodiments, the female terminal 30 is shown as an example. However, this specification can be applied to terminals in general provided with a coating crimping portion, such as male terminals provided with a coating crimping portion to be crimped to an insulation coating.

LIST OF REFERENCE SIGNS

10: wire with terminal
20: wire
21: core
22: insulation coating
30: female terminal (terminal)
34: coating crimping portion
39, 139: coating crimping piece (coating crimping portion)
41, 141: compressing portion
42, 142: compressing surface

The invention claimed is:

1. A terminal to be connected to an end of a wire in which a core is covered with an insulation coating, the wire being pulled out rearwardly, the terminal comprising:

a coating crimping portion having two coating crimping pieces extending away from one another in directions intersecting a pull-out direction of the wire and each of the coating crimping pieces having an inner surface to be crimped to an outer peripheral surface of the insulation coating and an outer surface opposite the inner surface, each of the coating crimping pieces having a rear edge facing in the pull-out direction of the wire and a front edge opposite the rear edge, the rear edge being substantially normal to the inner surface;

wherein:

compressing portions are formed at positions spaced from one another on the front edge of each of the coating crimping pieces, each of the compressing portions is open both on the front edge and on the inner surface, and is provided by recessing the respective coating crimping piece to have an internal space narrowed at farther distances from the front edge of the respective coating crimping piece; and each of the compressing portions has a flat triangular, compressing surface with one side where the front edge and the outer surface of the respective coating crimping piece meet and further having a point at the inner surface of the respective coating crimping piece rearward of the front edge, each of the compressing portions further having two side surfaces extending from the compressing surface of the respective compressing portion to the inner surface of the respective crimping piece so that the compressing portions press the insulation coating to gradually compress the insulation coating toward the rear edge with the coating crimping pieces crimped to the insulation coating, and each of the triangular compressing surfaces is formed symmetrically in the pull-out direction of the wire.

2. The terminal of claim 1, wherein a depth of the compressing portion in a thickness direction of the coating crimping portion is decreased gradually toward the rear edge.

3. The terminal of claim 1, wherein a length of each of the compressing portion in a direction extending from the front edge to the rear edge of the respective coating crimping piece is substantially equal to a depth of each of the compressing portions from the inner surface to the outer surface of the respective coating crimping piece.

4. The terminal of claim 1, wherein the rear edge of each of the coating crimping pieces has no compressing portions.

5. The terminal of claim 1, wherein each of the compressing portions is provided to have a smaller depth from the crimping surface in a plate thickness direction at farther distances from the front edge of the respective coating crimping piece.

6. The terminal of claim 5, wherein the compressing surface of each of the compressing portions to be brought into contact with the insulation coating in the plate thickness direction is a flat isosceles triangular compressing surface.

7. A terminated wire assembly, comprising:

a wire in which a core is covered with an insulation coating; and a terminal connected to the wire, the terminal having two coating crimping pieces extending in directions intersecting a pull-out direction of the wire and inner surfaces crimped to an outer peripheral surface of the insulation coating and an outer surface opposite the inner surface, each of the coating crimping pieces having a rear edge facing in the pull-out direction of the wire and a front edge opposite the rear age, the rear edge being substantially normal to the inner surface;

wherein:

compressing portions are formed at positions spaced from one another on the front end edge of each of the coating crimping pieces, each of the compressing portions is open both on the front edge and the inner surface, and is provided by recessing the respective coating crimping piece to have an internal space narrowed at farther distances from the front edge of the respective coating crimping piece; and each of the compressing portions has a flat triangular, compressing surface with one side where the front edge and the outer surface of the respective coating crimping piece meet and further having a point at the inner surface of the respective coating crimping piece rearward of the front edge, each of the compressing portions further having two side surfaces extending from the compressing surface of the respective compressing portion to the inner surface of the respective crimping piece so that the compressing portions press the insulation coating to gradually compress the insulation coating toward the rear edge with the coating crimping pieces crimped to the insulation coating, and each of the triangular compressing surfaces is formed symmetrically in the pull-out direction of wire.

8. The terminal of claim 7, wherein a depth of the compressing portion in a thickness direction of the coating crimping portion is decreased gradually toward the rear edge.

9. The terminal of claim 7, wherein a length of each of the compressing portions in a direction extending from the front edge to the rear edge of the respective coating crimping piece is substantially equal to a depth of each of the compressing portions from the inner surface to the outer surface of the respective coating crimping piece.

10. The terminal of claim 7, wherein the rear edge of each of the coating crimping pieces has no compressing portions.

11. The terminal of claim 7, wherein each of the compressing portions is provided to have a smaller depth from the crimping surface in a plate thickness direction at farther distances from the front edge of the respective coating crimping piece.

12. The terminal of claim 11, wherein the compressing surface of each of the compressing portions to be brought into contact with the insulation coating in the plate thickness direction is a flat isosceles triangular compressing surface.

* * * * *